US005101186A

United States Patent [19]

Durum

[11] Patent Number: 5,101,186

[45] Date of Patent: Mar. 31, 1992

[54] CIRCUIT BREAKER UTILIZING DEFORMABLE SECTION BLADE

[75] Inventor: Metin M. Durum, Elmhurst, Ill.

[73] Assignee: Square D Company, Palatine, Ill.

[21] Appl. No.: 629,937

[22] Filed: Dec. 19, 1990

[51] Int. Cl.[5] ..... H01H 71/16; H01H 61/04; H01H 73/48

[52] U.S. Cl. ..... 337/76; 337/85; 335/23

[58] Field of Search ..... 337/76, 85, 89, 98, 337/2, 3, 90, 111, 379; 335/20, 23, 145

[56] References Cited

U.S. PATENT DOCUMENTS 2,689,285 9/1954 Drobney et al. ..... 337/85

*Primary Examiner*—Harold Broome

*Attorney, Agent, or Firm*—Larry I. Golden; Jose W. Jimenez

[57] ABSTRACT

An improved low-cost circuit breaker mechanism is provided which dispenses with the complicated and costly conventional use of latch mechanisms for realizing the tripping action. The circuit breaker mechanism essentially comprises an input electrical terminal having an associated contact where current is received, an output electrical terminal where current is delivered out of the breaker, and a conductive deformable section cantilever blade formed of thermostat metal and adapted to establish a conductive current path between the input contact and the output terminal. The cantilever blade is disposed in a normally closed position with a first end affixed to the output terminal and a second free end contacting the input contact, and is adapted to deflect from its normal closed position to an open position for interrupting current flow when the temperature of the cantilever blade increases as a result of the monitored current exceeding a threshold value. The circuit breaker mechanism is provided with means for exerting a mechanical force for stimulating the cantilever blade, after it has been deflected by an over-current condition, back to its normal closed position. A remote control arrangement is also provided which permits remote activation of the circuit breaker mechanism by effectuating the force required to effectively deflect the cantilever blade by exertion of appropriate electromagnetic fields on an armature element linked to the blade.

14 Claims, 3 Drawing Sheets

CIRCUIT BREAKER UTILIZING DEFORMABLE SECTION BLADE

BACKGROUND OF THE INVENTION

1. Field of the Invention

This invention generally relates to electric circuit breakers More particularly, the invention deals with an improved low-cost, high-speed circuit breaker mechanism.

2. Description of the Related Art

Circuit breakers are ubiquitous in modern day electric systems, both residential and industrial, and constitute an indispensable component of such systems toward providing protection against over-current conditions. Various circuit breaker mechanisms have evolved and been perfected over time on the basis of application-specific factors such as current capacity, response time, and the type of reset (manual or remote) function desired of the breaker.

With particular reference to residential applications, thermo-magnetic circuit breakers have been conventionally used. Such conventional breakers typically utilize a bi-metal or thermostat metal element deflecting with changes in temperature due to resistance heating caused by flow of electric current through the blades. The thermostat metal element is typically in the form of a blade and operates in conjunction with a latch so that blade deflection releases the latch after a time delay corresponding to a predetermined over-current threshold in order to "break" the current circuit associated therewith.

Latch-based circuit breaker mechanisms of this type generally include an electro-magnet operating upon a lever to release the breaker latch in the presence of a short circuit or very high current condition. A handle or push button mechanism is also provided for opening up the electric contacts to the requisite separation width and sufficiently fast to realize adequate current interruption.

Conventional circuit breaker designs embodying a latch mechanism of the foregoing type are complex in implementation because the latch mechanism and the associated components for realizing the activation and deactivation thereof add significantly to the overall part count for the breaker mechanism. Consequently, such arrangements entail increased material costs as well as assembly costs due to the relatively large number of parts and the increased assembly time.

Further, calibration of such breaker mechanisms is rendered difficult, and repeatability is adversely affected by the high degree of inter-component friction occurring as a result of the plurality of sliding and interacting surfaces associated with the latch mechanism. In addition, the adaptation of latch-based circuit breaker mechanisms for use with remote control arrangements is extremely difficult and complex.

Accordingly, there exists an apparent need for a low-cost circuit breaker mechanism which is based on a simple design and avoids the problems inherently associated with the use of latch mechanisms.

SUMMARY OF THE INVENTION

In view of the foregoing, it is a primary object of the present invention to provide a low-cost circuit breaker based on a simple design which does not require the use of a latch mechanism for realizing the tripping action.

A related object is to provide such an improved circuit breaker wherein the tripping action is realized by using a reduced number of components and associated moving parts and/or sliding surfaces.

Yet another object of the present invention is to provide a circuit breaker of the above type which is easy to assemble and can be calibrated conveniently.

A further object is to provide such an improved breaker which provides faster current interruption and is particularly adapted for use with remote control arrangements.

Briefly, in accordance with the principles of this invention, the above and other objects are realized by a circuit breaker using a thermostatic deformable section blade as the principal element of the breaker mechanism. The improved circuit breaker mechanism essentially comprises an input electrical terminal having an associated contact where the current to be monitored is received, an output electrical terminal where the current is delivered out of the breaker mechanism, and a conductive element adapted to establish a conductive current path between the input contact and the output terminal, the element comprising a thermostatic bi-metallic or tri-metallic cantilever blade disposed in a normally closed position with a first fixed end connected to the output terminal, and a second deflectable end contacting the input contact.

The cantilever blade is adapted to deflect from its normal closed position when the temperature of the blade increases as a result of the current carried by the blade exceeding a threshold value, thereby automatically breaking the contact between the second end of the cantilever blade and the input contact, and, consequently, breaking the flow of current being carried by the cantilever blade between the input and output terminals.

According to a preferred embodiment, the cantilever blade of the circuit breaker mechanism is formed of a thermostat metal and comprises at least two metallic strips which are bonded together and have substantially differing coefficients of thermal expansion. Preferably, the cantilever blade is in the form of a substantially rectangular strip of a thermostat bi-metal (or, alternatively, tri-metal) which is fashioned to be straight in its longitudinal dimension and curved along its transverse direction. The material chosen for the thermostat bi-metal strip is such that the coefficient of expansion of the metal on the concave side of the curved strip is substantially larger than that of the metal on the convex side of the curved strip.

The thermostat cantilever blade is mounted within the circuit breaker housing in such a way as to be affixed to the output terminal at a first fixed end through a support element which restrains the curvature of the blade. The cantilever blade is positioned in a normally closed position in contact with the input contact under a bending moment generated by a spring which tends to move the second end of the cantilever blade, i.e., the free end, away from the input contact. The arrangement is such that the blade has a variable sectional moment of inertia which resists blade deflection away from contact with the input contact even under application of the bending moment thereto.

The sectional moment of inertia of the cantilever blade decreases with (i) the application of mechanical force to the cantilever blade so as to reduce the curvature of a defined blade section, thereby causing blade deflection about that section, or (ii) an increase in blade temperature resulting from an increase in current carried by the blade beyond a threshold value, so as to cause a reduction in the curvature of the blade section, thereby causing blade deflection away from the input contact at a point remote from the restraining support element.

The application of mechanical force to the cantilever blade or the resistive heating of the blade affects the curved cross-sections of the blade in such a manner that such sections undergo a reduction in curvature, i.e., become shallower, and cannot resist the bending moment applied to the blade through the spring. As a result, the deformable cantilever blade deflects or "kinks" at the point where the section curvature is sufficiently reduced relative to the applied bending moment.

In effect, the kinked section acts as a frictionless curved hinge about which the blade swings or deflects and, consequently, opens the electrical connection between the second end, i.e., the free end of the blade, and the input contact. Because the bending moment initiated by the spring is further increased due to the large deformation of the cantilever blade, the kinked blade is unable to recover to its original normally closed position and the electrical connection remains open until the circuit breaker is reset by application of a mechanical force which "unkinks" the cantilever blade and permits it to deflect back to its normal position in contact with the input contact.

The circuit breaker mechanism of this invention is provided with means for application of mechanical force to the metallic cantilever blade in order to effectuate deflection thereof between the normally closed position and the deflected position away from the input contact. According to an illustrative embodiment of this invention, the mechanical force application means includes a moveable element linked to the cantilever blade and having an associated handle manually operable for activating the moveable element so as to apply the requisite mechanical force and realize blade deflection.

According to another embodiment of this invention, which is particularly adapted for remote operation of the circuit breaker, the mechanical force application means includes a moveable element which is also linked to the cantilever blade but is activatable by attraction of an armature element connected thereto. The armature element itself is capable of being deflected from a remote location by generation of appropriate electromagnetic fields around the element by activation of current coils disposed on either side of the armature element, thereby allowing remote activation of the breaker mechanism by corresponding deflection of the armature element and, hence, the metallic cantilever blade.

BRIEF DESCRIPTION OF THE DRAWINGS

The basic features and advantages of the present invention will become apparent in the following detailed description and upon reference to the drawings in which.

Figure 1:
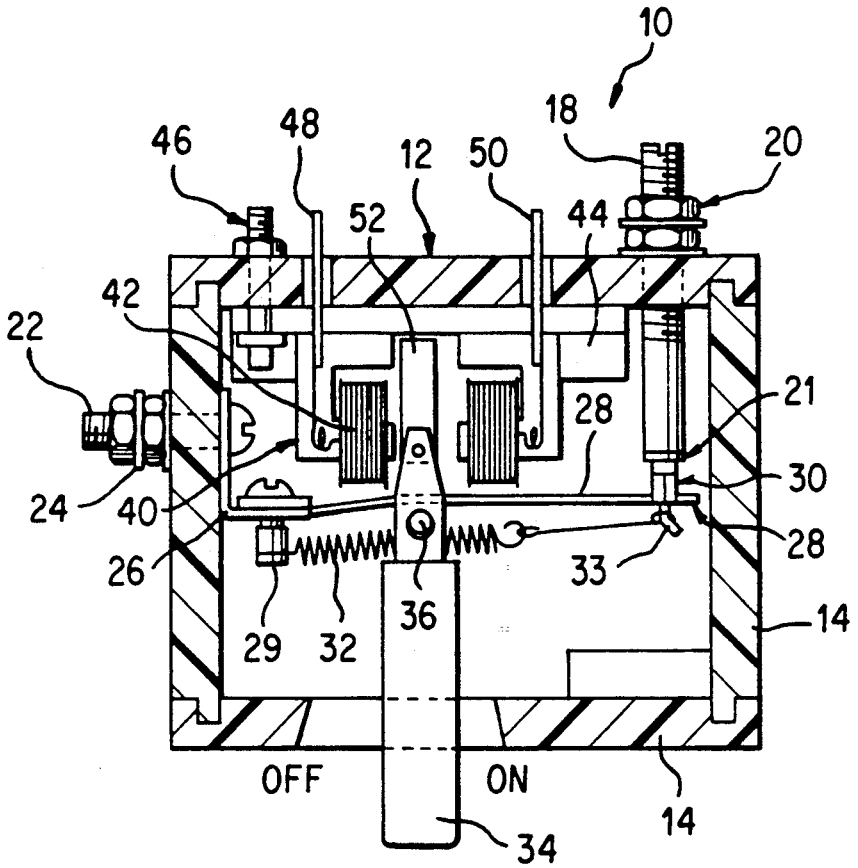
FIG. 1 is a front view of the internal configuration of an improved circuit breaker mechanism in accordance with a preferred embodiment of this invention.

While the invention is susceptible to various modifications and alternative forms, specific embodiments thereof have been shown by way of example in the drawings and will be described in detail herein. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 2:
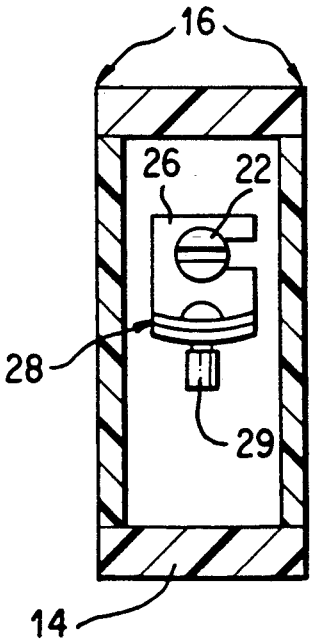
FIG. 2 is a side view of the circuit breaker arrangement of FIG. 1.

Referring now to the drawings, and particularly to FIGS. 1 and 2, there is shown a circuit breaker arrangement in accordance with a preferred embodiment of the present invention. As shown therein, the circuit breaker 10 includes a housing generally designated by the reference numeral 12 which is formed of a plurality of frame members 14 within which the circuit breaker mechanism to be described below is positioned. A pair of cover members 16 function as lids for covering the open frame defined by the frame members 14 so as to totally enclose the overall circuit breaker mechanism.

The circuit breaker mechanism includes a current inlet terminal 18 which projects outwardly from one of the frame members 14 and is affixed thereto by means of a support nut/washer arrangement 20. The current inlet terminal 18 is formed of a conductive metal and projects downwardly into the circuit breaker housing enclosure to define a fixed input contact 21 at its internal end. A current outlet terminal 22 projects outwardly from an adjacent frame member 14 and is affixed thereto by means of a nut/washer arrangement 24. The end of the current outlet terminal 22 which projects inwardly from the frame member 14 has attached thereto a downwardly depending conductive bracket 26.

According to an important feature of this invention, the establishment of a conductive current carrying path between the input contact 21 and the output bracket 26 connected to the output terminal 22 is accomplished by means of a metallic thermostatic cantilever blade 28 which is disposed in a normally closed position with a first end contacting the input contact 21 and a second end connected to the output bracket 26 so as to allow passage of current from the current inlet member 18 to the current outlet member 22.

The cantilever blade 28 is anchored on its first end to the output bracket 26 and includes a substantially cylindrical conductive contact element 30 disposed at its second end, i.e., its free end, for enhanced electrical contact between the blade 28 and the input contact 21. The cantilever blade 28 is mounted in its normal closed position in contact with the input contact 21 under the influence of a bending moment initiated about its free end. This bending moment is preferably generated by means of a spring element 32 anchored between the blade support element 29 and an anchoring pin 33 disposed about the free end of the cantilever blade 28 approximately below where the contact element 30 is located on the blade 28.

The bi-thermostatic cantilever blade 28 is adapted to deflect from its normal closed position when the temperature of the blade increases as a result of the current being carried thereupon exceeding a predefined threshold value, thereby breaking the contact between the contact element 30 on the free end of the cantilever blade and the input contact 21 on the current inlet terminal 18 so as to effectively interrupt or break the flow of current between the input and output terminals.

More specifically, in accordance with the system of the present invention, the cantilever blade is formed of a thermostat metal comprising at least two metal strips which are bonded together and have substantially differing coefficients of thermal expansion. The thermostat metal used to form the cantilever metallic blade is a composite material comprising two or more materials of an appropriate nature which, by virtue of the differing coefficients of expansion, tend to alter the curvature of the strip when the temperature of the strip undergoes change.

In the case of a thermostat bi-metal, for instance, when two metal strips having substantially differing thermal expansion coefficients are bonded together, clamped on either ends thereof, and subjected to a rise in temperature, the metal strip with the higher expansivity is placed under uniform compression, and the metal with the lower expansivity is placed under uniform tension. These opposing forces produce a bending moment and, when the clamping restraints on either side of the bonded metallic strips are released, the free metallic strip assumes a uniform arc. Such temperature-induced curvature of cantilever strips is well known. If the cantilever blade is originally straight or has an initial uniform curvature, the resulting curvature for uniform temperature change is also uniform Thus, if the ambient temperature to which the cantilever blade is exposed remains uniform, temperature-induced curvature of the cantilever blade results in a true arc of constant radius since the stresses producing the bending moment in the cantilever blade are uniform for any cross section.

According to a feature of this invention, the cantilever blade formed of thermostat metal is in the form of a substantially rectangular bi-metallic strip which, as seen in FIGS. 4A and 5A–C, is straight in its longitudinal dimension "L" and curved along its transverse direction "W." (Alternatively, a tri-metallic strip may also be used.) The thermostat metal is selected to be such that the coefficient of expansion of the metal on the concave side of the curved blade is larger than that of the metal on the convex side of the blade. Various types of thermostat metals of this type are commercially available. In a preferred embodiment, the cantilever metallic blade was formed of thermostat metal commercially designated as P40R and marketed by the Metallurgical Materials Division of Texas Instruments, Inc. of Massachusetts.

Figure 4:
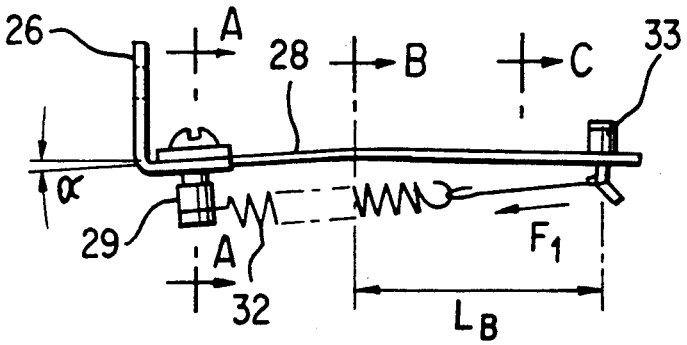
FIG. 4 is a side view illustrating only the cantilever blade and spring unit in its normally closed position.
Figure 4A:
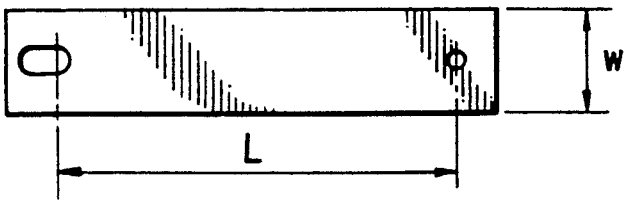
FIG. 4A is a top view of the cantilever blade shown in FIGS. 1–4.

As best illustrated in FIG. 4, the cantilever blade 28 is affixed to the output bracket 26 in such a manner that the support element 29 restrains the curvature of the blade at its fixed end. The action of the spring element 32 exerts a pulling force $F_1$ about the anchoring pin 33 and sets up a bending moment acting upon the blade 28.

When a bending moment is applied to a straight cantilever blade in this manner, the blade bends about its neutral axis to define a circular arc of a radius "r". The curvature (1/r) of the blade is related to the bending moment (M) by the following equation:

$$1/r = M/(E.I) \quad (1)$$

where E is the elastic modulus of the blade material and I is the sectional moment of inertia.

However, if the cantilever blade is made of a bi-metallic strip of the type described above, the equivalent elastic modulus ($E_E$) is practically defined by the following equation:

$$E_E = 4\,(E_A^{-\frac{1}{2}} + E_B^{-\frac{1}{2}})^{-2} \quad (2)$$

The relationship defined by Equation (2) is exact in the case where the optimum thickness ratio of the materials used for forming the bi-metallic blade is defined by the following relationship:

$$t_B/t_A = E_A^{\frac{1}{2}}/E_B^{\frac{1}{2}} \quad (3)$$

Where the bi-metallic strip or blade is transversely curved, for instance, in the form of a circular arc-shaped section, as in the case of the preferred embodiment described above, the sectional moment of inertia (I) of the blade is directly proportional to the curvature (1/r) or the bending moment (M). With one end of such a cantilever blade being fixed, the strip deflects or "kinks" when the bending moment reaches a critical value. However, where the curvature of a section of the transversely curved blade has increased, there is a corresponding decrease in the sectional moment of inertia (I), and the cantilever blade deflects or "kinks" at a relatively low critical bending moment Accordingly, the deflection of the cantilever metallic blade 28 in the circuit breaker arrangement of FIGS. 1 and 4 can be realized by appropriately controlling or changing the sectional moment of inertia (I) of the blade. The sectional moment of inertia may, for instance, be changed by mechanical bending of the cantilever blade by application of a force which pushes or pulls the blade, or by application of a couple which bends the blade until a critical bending moment is reached.

This inertial change can also be affected more conveniently by means of a mechanical force which squeezes a curved section of the blade appropriately. Squeezing or pinching the curved section over the blade faces decreases the degree of curvature of the blade section and, accordingly, decreases the sectional moment of inertia about that section. Conversely, squeezing the curved section over the sides of the curved cantilever blade increases the curvature thereof and, accordingly, increases the sectional moment of inertia correspondingly.

Finally, since the cantilever blade is constructed of a thermostat metal which is highly sensitive to temperature changes, the curvature of sections of the cantilever blade changes with temperature and has a corresponding effect on the sectional moment of inertia and, hence, the deflection of the blade. More specifically, the curvature (1/R) of the cantilever blade section changes with temperature in accordance with the following relationship:

$$1/R_2 - 1/R_1 = 3/2(\alpha_B - \alpha_A)\,(T_2 - T_1)/t \quad (4)$$

where $\alpha_A$ and $\alpha_B$ are the coefficients of thermal expansion of the metals forming the blade, "t" is the total blade thickness equal to the sum of the individual thickness of each of the metals comprising the cantilever blade, and $T_1$ and $T_2$ correspond to the changed temperature and the initial temperature, respectively. It is clear from Equation (4) that an increase in temperature (T) brings about a corresponding decrease in the sectional moment of inertia (I) as long as $\alpha_A$ is greater than $\alpha_B$.

Figure 6:
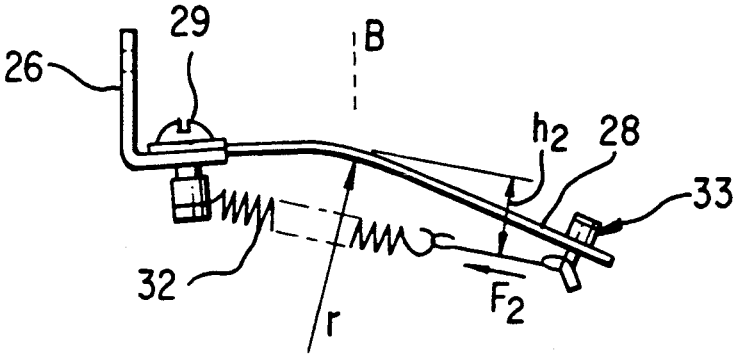
FIG. 6 is a side view illustrating only the cantilever blade and spring unit of FIG. 4 in a kinked position.

In view of the foregoing, it will be appreciated that when the ratio of blade elasticity to the radius of curvature (E/R), which, in turn, corresponds to the ratio of the bending moment to the sectional moment of inertia (M/I) of the cantilever blade, increases as a result of any of the previously noted factors and reaches a critical level, the blade deflects from its normally closed position and "kinks" or "snaps" under the application of the bending moment When, as in the case of the preferred embodiment, the cantilever blade is uniformly curved (i.e., has a constant radius of curvature), the kink or snap occurs at a point along the blade far enough from the support element 29 (see FIG. 6) where the restraining effect on the blade curvature is sufficiently reduced and the bending moment (M) generated by the effect of the spring element 32 is sufficiently high.

Figure 5A:
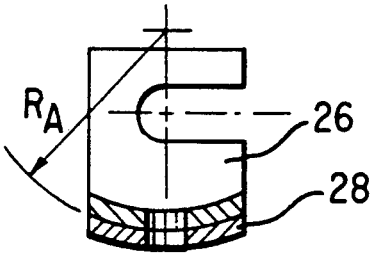
FIG. 5A, B, and C are side views taken substantially along the sectional lines shown in FIG. 4.
Figure 5B:
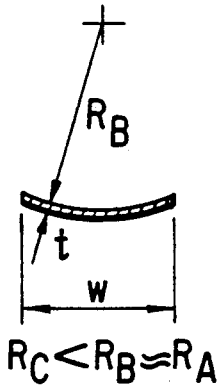
Figure 5C:
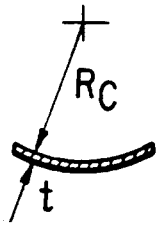

FIGS. 5A, 5B and 5C are illustrations of the variation in the radius of curvature of the metallic cantilever blade described above across the length thereof. More specifically, FIG. 5A shows the radius of curvature as being equal to $R_A$ at the sectional point A in FIG. 4 where the blade 28 is restrained by the support element 29. The radius of curvature remains substantially the same up to the point B ($R_B \approx R_A$) beyond which the blade kinks. The radius is gradually reduced beyond the point B and at the illustrated point C the radius of curvature $E_C$ is noticeably less than the other illustrated radii.

It should be noted that the specific location on the blade where the kink or snap occurs can be defined with particularity by using a thermostat metal only for that segment of the blade about which the kink is to occur, or by relatively stiffening the remaining section of the blade, for instance, by curving the sections of the cantilever blade outside the designated "kinked" segment of the blade to have a relatively smaller radius of curvature. It should also be noted that such a kinked segment becomes practically cylindrical and spreads along the longitudinal dimension of the blade by further increase in the bending thereof.

In effect, the kinked segment of the cantilever blade acts a frictionless hinge offering a very small elastic resistance to bending. Under these conditions, as soon as kinking of the cantilever blade occurs, the blade swings about this effective elastic hinge under the tension or bending moment induced by the spring element 32 and displaces the contact element 30 on the free end of the blade away from the stationary input contact 21 (see FIGS. 3 and 6).

As shown in the illustration of FIG. 4, a pulling force $F_1$ is exerted by the spring element 32 and the curvature restraining effect produced on the cantilever blade by the support element 29 reaches a critical value at the point where the section line B is drawn. The distance between this point and the movable contact element 30 on the free end of the cantilever blade is represented as being equal to $L_B$. Also, at this point, the vertical distance between the longitudinal axis of the spring element 32 and the cantilever blade is shown as being equal to $h_1$.

When the sectional moment of inertia (I) at the point B decreases to the critical value, the cantilever blade 28 snaps about that point and comes to rest with the moving contact point 30 on the blade being spaced downwardly apart by a distance "G" (see FIG. 3) from the input contact 21 in its original, normally closed blade position. Preferably, the arrangement is such that the separating distance G is about 0.500 inches. In the snapped position of the blade, the vertical distance $h_2$ (see FIG. 6) between the point where the blade snaps and the longitudinal axis of the spring element 32 is relatively larger and a pulling force $F_2$ is exerted on the free end of the cantilever blade. The arrangement is such that the pulling force $F_2$ exerted by the spring element in the snapped position of the cantilever blade retains the blade in its snapped position even after the stimulus resulting in the blade deflection ceases to exist. At this point, some external stimulus is again required for moving the blade back into its original normally closed or "unsnapped" position.

In operation in over-current protection applications, the circuit breaker arrangement described above operates with the cantilever blade in its normally closed position so as to establish electrical contact between the stationary input contact 21 connected to the inlet terminal 18 and the output bracket 26 connected to the outlet terminal 22. Electrical current that is being monitored by the circuit breaker, thus, sequentially passes through the current inlet terminal 18, the stationary contact 21, the moving contact 30 on the free end of the cantilever blade 28, the blade 28 itself, the output bracket 26 and out of the circuit breaker through the current outlet 22. The passage of this current raises the operational temperature of the cantilever blade and weakens the blade resistance to the bending moment resulting from the tension exerted by the spring element 32 and effectively reduces the sectional moment of inertia of the blade.

When the current carried by the blade reaches a threshold value, (which is dependant upon the blade dimensions and the thermostat metal used and can be calculated using standard well-known mathematical relationships) the blade 28 kinks or snaps and immediately opens the contact between the moving contact 30 on the blade 28 and the stationary 21 contact after a time delay depending on the degree to which the threshold current value is exceeded. In practical terms, this time delay is short enough that any cooling effects may be safely ignored. After the current flow is interrupted, the cantilever blade 28 cools off and tends to return to its normally closed position. The tension of the spring element 32, however, is adjusted to be such that the bending moment exerted thereby upon the blade is large enough to retain the blade in its OFF position away from any contact with the stationary input contact 21.

In order to reset the circuit breaker arrangement shown in FIG. 1 after the cantilever blade has snapped as a result of an over-current condition, the circuit breaker mechanism is provided with means for applying a mechanical force which allows the snapped blade to deflect back to its original normally closed position. More specifically, in the preferred embodiment, an arm unit 34 is provided for bending the cantilever blade 28 about the point where the blade initially snapped in order that the blade can deflect or spring back into its normally closed position. In order to accomplish this, the arm unit 34 is mounted for pivoting movement about an anchoring pin 36 (see FIGS. 1 and 7) which extends across the two covers 16 of the circuit breaker housing 12.

The bending action on the cantilever blade is realized by means of a fork unit 38 which extends from an extending portion 39 of the arm unit 34 and is adapted to encompass the blade in a transverse direction when the arm unit is in position. Under these conditions, pivoting movement of the arm unit 34 brings about efficient bending or pinching of the cantilever blade as the handle is moved from the OFF position shown in FIG. 3, where the blade is in a snapped position, to an ON position, where the arm unit is substantially vertical and the blade is positioned in its original normally closed position.

Because of the above-described manner in which the arm unit 34 contacts the cantilever blade, even when the pivotable arm unit 34 is in its ON position with the moving contact 30 on the blade in contact with the stationary input contact 21, occurrence of an over-current condition can still bring about snapping of the blade under the bending moment exerted by the spring element 32, by virtue of the thermostatic blade deflection process described above. The arrangement thus provides an added degree of safety whereby the circuit breaker remains activatable for current interruption even if the arm unit 34 is left in its ON position during normal operation.

Figure 3:
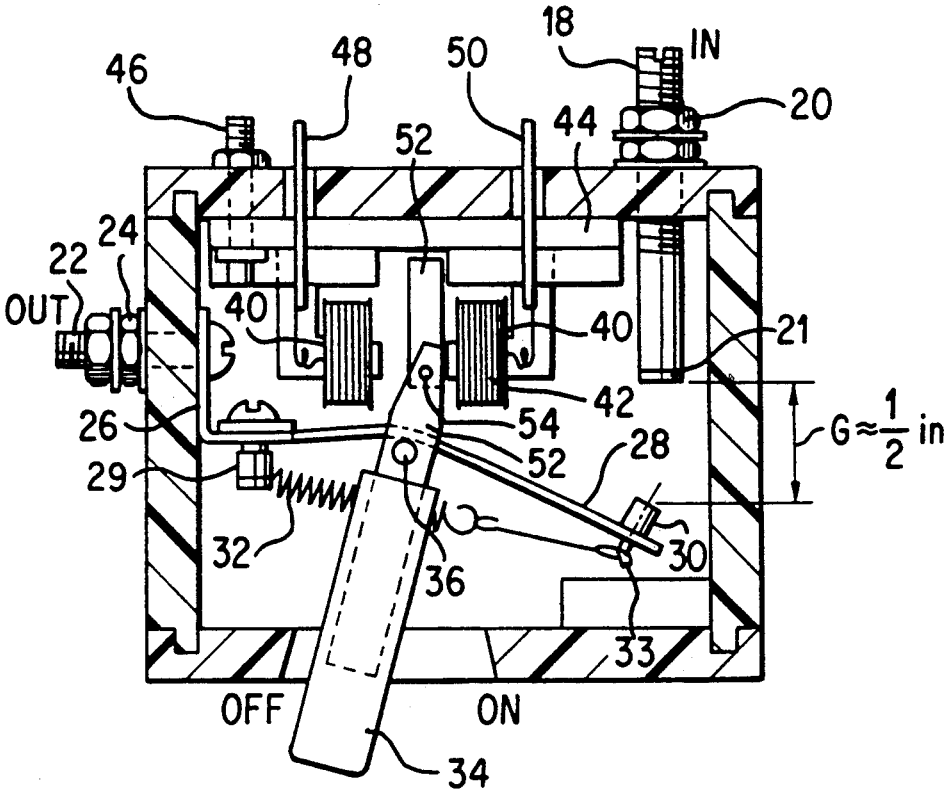
FIG. 3 is an illustration of the circuit breaker arrangement of FIG. 1 with the cantilever blade in its deflected or kinked position.

In accordance with another feature of this invention, the circuit breaker arrangement described in detail above is particularly adapted for being remotely activated for both setting and resetting the circuit breaker. More specifically, as shown in FIGS. 1 and 3, a pair of iron cores 40 having electrical coils 42 mounted thereupon are positioned on a holder 44 formed of an insulating material. The iron-cored coils 42 function as electromagnets and are positioned above the cantilever blade 28 in a centered fashion relative to the point where the cantilever blade snaps. The pair of coils 42 have one end thereof linked to a common point contact 46 and have corresponding remote ends linked to separate ON/OFF leads 48, 50, respectively.

Figure 7:
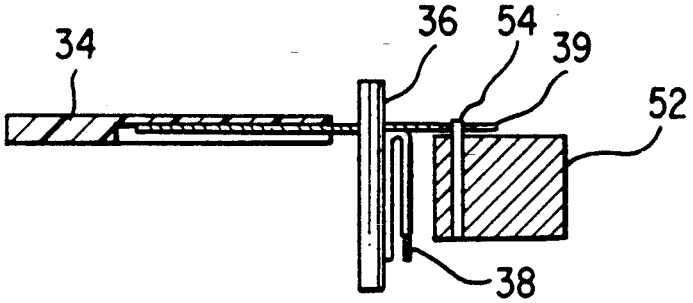
FIG. 7 is a side view illustrating in detail the actuator mechanism used for application of the mechanical deflection force in operating the circuit breaker arrangement of FIG. 1.

In the arrangement of FIGS. 1 and 3, the arm unit 34 is adapted for being deflected by the action of the electromagnetic coils 42 by means of an armature element 52 connected to the portion 39 of the arm unit 34 which extends upwardly beyond the cantilever blade 28 (see FIG. 7). The armature element 52 projects into the area between the pair of electrical coils 40 and, accordingly, comes under the influence of electromagnetic fields generated therefrom when the respective coils are appropriately energized through the ON/OFF leads or contacts 48 and 50. In particular, when an appropriate one of the electromagnetic coils 42 is activated, it pulls or activates the armature element 52 to an OFF position whereby a mechanical force is applied to the cantilever blade 28 and deflects the arm unit 34 and, hence, the cantilever blade, to the OFF position. When the other electromagnetic coil is activated, it influences the armature element 52 in such a way as to deflect the arm unit 34 and, hence, the cantilever blade 28, to the ON position. It will be apparent that the two electromagnetic coils 42 can be activated remotely by energizing appropriate ones of the leads 48 and 50, thereby allowing convenient remote operation (both setting and resetting) of the circuit breaker arrangement.

According to a feature of this invention, the armature element 52 is mounted upon the arm unit 34 in such a manner as to permit pivotable movement therebetween. More specifically, the armature element 52 is mounted to the extending portion 39 of the arm unit 34 through a roll pin 54 which extends transversely through the arm unit and allows the armature element 52 to pivot toward and away from the two electromagnetic coils 40 between which the element is disposed.

If the armature element were to be affixed to the arm unit 34 in a rigid fashion, remote activation of the circuit breaker requires the generation of a fairly high electromagnetic field in order to move the armature element 52, along with the accompanying inertia of the arm unit 34, across the air gap separating the armature element 52 and the corresponding electromagnetic coil 42 to which it is attracted. The advantage with the pivotable mounting of the armature element is that, when the armature element 52 comes under the influence of the field created by one of the electromagnetic coils, only the armature element is initially attracted and pulled toward the corresponding coil by virtue of easy pivotal movement of the element 52 about the roll pin 54, without necessitating the movement of the complete arm unit.

The pivotal movement of the armature element 52, however, is restricted to the point where the armature element has traversed approximately half the air gap between the element 52 and the corresponding coil 42. At that point, the rest of the arm unit 34 is also pulled along with the armature element 52 until the requisite ON/OFF positions are realized. The end result of such a pivotable or articulated armature arrangement is that a substantially reduced electrical field is needed for bringing about remote activation of the circuit breaker mechanism.

It should be understood that the deflection of the cantilever blade required for operation of the above-described circuit breaker mechanism may also be realized by using electromagnetic means acting directly upon the blade itself. In such an implementation, deflection can be realized by disposing an appropriate core/armature unit (not shown) surrounding the blade at the point where kinking or snapping of the blade is desired; a strong magnetic flux can thus be generated at the snap point in order to simulate the exertion of mechanical force, as described above. In a preferred arrangement, such a core/armature unit would be activated by the current carried by the blade itself when it reaches an "over-current" value, without any need for a separate electric current or circuit for the unit.

In view of the foregoing, it will be apparent that the present invention provides an improved circuit breaker mechanism which dispenses with the complicated and costly latching mechanisms used by conventional circuit breakers for realizing the tripping action. The invented circuit breaker mechanism utilizes a substantially reduced number of components and associated moving and/or sliding surfaces, provides fast current interruption, and is particularly adapted for use with remote control arrangements. The disclosed circuit breaker arrangement has an added advantage in that the arrangement is susceptible to complete Z-axis assembly (as evident from FIGS. 1, 2 and 3), thereby significantly simplifying the assembly procedure and reducing associated assembly costs.

I claim:

1. An improved circuit breaker mechanism for monitoring and directing current associated with an electrical circuit, said breaker mechanism comprising:

an input electrical terminal having an associated contact where said current is received, an output electrical terminal where said current is delivered out of said breaker mechanism, and a conductive element adapted to establish a current path between said input contact and said output terminal, said element comprising a blade disposed in a normally closed position with a first end contacting one of said input contact or said output terminal and a second end contacting the other of said input contact or said output terminal, said blade being in the form of a substantially rectangular strip of metal which is straight in its longitudinal dimension and having curvature along its transverse direction, said blade being positioned in contact with said input contact under a bending moment which tends to move the second end of said blade away from said input contact, said blade adapted to deflect from said normal closed position when the temperature of said blade increases as a result of said monitored current exceeding a threshold value, thereby breaking the contact between said second end of said blade and said other one of said input contact or said output terminal, and breaking the flow of said current between said input and output terminals.

2. The improved circuit breaker mechanism of claim 1 wherein said blade is formed of a thermostat metal and comprises at least two metal strips which are bonded together and have substantially differing coefficients of thermal expansion, the coefficient of thermal expansion of the metal on the concave side of said curved strip being larger than that of the metal on the convex side.

3. The improved circuit breaker mechanism of claim 2 wherein said blade is affixed to said output contact at its first end through a support element which restrains the curvature of said blade at said first end, said blade being positioned in contact with said input contact under a bending moment generated by a spring which tends to move the second end of said blade away from said input contact.

4. The improved circuit breaker mechanism of claim 3 wherein said blade has a variable sectional moment of inertia which resists blade deflection away from contact with said input contact under application of a bending moment thereto, said sectional moment of inertia decreasing with (i) the application of mechanical force to said blade so as to reduce the curvature thereof at said section, thereby causing blade deflection about said section, or (ii) increase in blade temperature resulting from an increase in current carried by said blade, so as to cause a reduction in curvature of said blade at said section, thereby causing blade deflection at a point remote from said restraining support element.

5. The improved circuit breaker mechanism of claim 4 further including means for application of mechanical force to said blade to cause deflection thereof between said normally closed position and said deflected position away from said input contact.

6. The improved circuit breaker mechanism of claim 5 wherein said mechanical force application means includes an element pivotably linked to said point of force application and having an associated handle manually operable for activating said movable element so as to apply said mechanical force necessary to realize blade deflection.

7. An improved circuit breaker mechanism for monitoring and directing current associated with an electrical circuit, said breaker mechanism comprising:

an input electrical terminal having an associated contact where said current is received, an output electrical terminal where said current is delivered out of said breaker mechanism, and a conductive element adapted to establish a current path between said input contact and said output terminal, said element comprising a blade disposed in a normally closed position with a first end contacting one of said input contact or said output terminal and a second end the other of said input contact or said output terminal, said blade being in the form of a substantially rectangular strip of metal which is straight in its longitudinal dimension and having curvature along its transverse direction, said blade adapted to deflect from said normal closed position when the temperature of said blade increases as a result of said monitored current exceeding a threshold value, thereby breaking the contact between said second end of said blade and said other one of said input contact or said output terminal, and breaking the flow of said current between said input and output terminals, said blade being affixed to said output contact at its first end through a support element which restrains the curvature of said blade at said first end, said blade being positioned in contact with said input contact under a bending moment generated by a spring which tends to move the second end of cantilever blade away from said input contact, said blade having a variable sectional moment of inertia which resists blade deflection away from contact with said input contact under application of a bending moment thereto, said sectional moment of inertia decreasing with (i) the application of mechanical force to said blade so as to reduce the curvature thereof at said section thereby causing blade deflection about said section, or (ii) increase in blade temperature resulting from an increase in current carried by said blade, so as to cause a reduction in curvature of said blade at said section, thereby causing blade deflection at a point remote from said restraining support element, said mechanism further including means for application of mechanical force to said blade to cause deflection thereof between said normally closed position and said deflected position away from said input contact, said mechanical force application means including an element pivotably linked to said point of force application and activated by deflection of an armature element connected thereto, said armature element capable of being deflected from a remote location by generation of an electromagnetic field around said element, thereby realizing remote activation of said breaker mechanism by corresponding deflection of said blade.

8. In a circuit breaker adapted to monitoring current flowing therethrough and interrupting current flow when the monitored current exceeds a threshold value, said breaker comprising an input electrical contact where the monitored current is received, an output electrical terminal where the monitored current is delivered out of the breaker, means for establishing a current path between the input contact and the output terminal, and means for interrupting the current path when the monitored current exceeds the threshold value, the improvement whereby said current path between said input contact and said output terminal is established by means of a conductive blade formed of thermostat metal, said blade being disposed in a normally closed position with a first end affixed to said output terminal and a second free end contacting said input contact, said thermostat blade being in the form of a substantially rectangular strip of metal which is straight in its longitudinal dimension and having curvature along its transverse direction said blade being positioned in contact with said input contact under a bending moment which tends to move the second end of said blade away from said input contact, said blade adapted to deflect from said normal closed position so as to break the contact between said free end and said input contact when the temperature of said blade increases as said monitored current exceeds said threshold value, thereby interrupting the flow of said monitored current between said input and output terminals.

9. The improved circuit breaker of claim 8 wherein said thermostat blade is formed of a thermostat bi-metal such that the coefficient of thermal expansion of the metal on the concave side of said curved strip is larger than that of the metal of the convex side.

10. The improved circuit breaker of claim 9 wherein said thermostat blade is affixed to said output contact at its first end through a support element which restrains the curvature of said blade at said first end, and said free end of said blade is positioned in contact with said input contact under a bending moment generated by a spring which tends to move said free end away from said input contact.

11. The improved circuit breaker of claim 10 wherein said thermostat blade has a variable sectional moment of inertia which resists blade deflection away from contact with said input contact under application of said bending moment thereto, said sectional moment of inertia decreasing with (i) the application of mechanical force to said blade so as to reduce the curvature thereof at said section, thereby causing blade deflection about said section, or (ii) increase in blade temperature resulting from an increase in current carried by said blade, so as to cause a reduction in the curvature of said blade at said section, thereby causing blade deflection at a point remote from said restraining support element.

12. The improved circuit breaker of claim 11 further including means for application of mechanical force to said blade to cause deflection thereof between said normally closed position and said deflected position away from said input contact.

13. The improved circuit breaker of claim 12 wherein said mechanical force application means includes an element pivotably linked to said point of force application and having an associated handle manually operable for realizing pivoting movement of said movable element so as to apply said mechanical force necessary to realize blade deflection.

14. In a circuit breaker adapted to monitoring flowing therethrough and interrupting current flow when the monitored current exceeds a threshold value, said breaker comprising an input electrical contact where the monitored current is received, an output electrical terminal where the monitored current is delivered out of the breaker, means for establishing a current path between the input contact and the output terminal, and means for interrupting the current path when the monitored current exceeds the threshold value.

the improvement whereby said current path between said input contact and said output terminal is established by means of a conductive blade formed of thermostat metal, said blade being disposed in a normally closed position with a first end affixed to said output terminal and a second free end contacting said input contact, said thermostat blade being in the form of a substantially rectangular strip of metal which is straight in its longitudinal dimension and curved along its transverse direction, said blade adapted to deflect from said normal closed position so as to break the contact between said free end and said input contact when the temperature of said blade increases as said monitored current exceeds said threshold value, thereby interrupting the flow of said monitored current between said input and output terminals, said blade being affixed to said output contact at its end through a support element which restrains the curvature of said blade at said first end, said blade being positioned in contact with said input contact under a bending moment generated by a spring which tends to move the second end of said blade away from said input contact, said blade having a variable sectional moment of inertia which resists blade deflection away from contact with said input contact under application of a bending moment thereto, said sectional moment of inertia decreasing with (i) the application of mechanical force to said blade so as to reduce the curvature thereof at said section, thereby causing blade deflection about said section, or (ii) increase in blade temperature resulting from an increase in current carried by said blade, so as to cause a reduction in curvature of said blade at said section, thereby causing blade deflection at a point remote from said restraining support element, said mechanism further including means for application of mechanical force to said blade to cause deflection thereof between said normally closed position and said deflected position away from said input contact, said mechanical force application means including an element pivotably linked to said point of force application and activatable by deflection of an armature element connected thereto, said armature element capable of being deflected from a remote location by generation of an electromagnetic field around said armature element, thereby realizing remote activation of said breaker mechanism by corresponding deflection of said blade.

* * * * *